United States Patent [19]

Grobbel

[11] Patent Number: 4,854,897

[45] Date of Patent: Aug. 8, 1989

[54] ELECTRICAL POWER DISTRIBUTION TERMINAL BLOCK ASSEMBLY

[75] Inventor: Ronald M. Grobbel, Warren, Mich.

[73] Assignee: Syndevco, Inc., Southfield, Mich.

[21] Appl. No.: 179,833

[22] Filed: Apr. 11, 1988

[51] Int. Cl.[4] ..... H01R 9/26

[52] U.S. Cl. ..... 439/716; 439/718

[58] Field of Search ..... 439/715–718; 174/138 F

[56] References Cited

U.S. PATENT DOCUMENTS

| | | | |
|---|---|---|---|
| 1,926,927 | 9/1933 | Woertz | 439/716 |
| 3,018,464 | 1/1962 | Mrenna et al. | 439/717 |
| 3,702,457 | 11/1972 | Fujita | 439/717 |

FOREIGN PATENT DOCUMENTS

| | | | |
|---|---|---|---|
| 1590344 | 7/1973 | Fed. Rep. of Germany | 439/716 |
| 2304639 | 8/1973 | Fed. Rep. of Germany | 439/716 |
| 0153305 | 6/1932 | Switzerland | 439/717 |
| 812645 | 4/1959 | United Kingdom | 174/138 F |
| 1046359 | 10/1966 | United Kingdom | 439/717 |

OTHER PUBLICATIONS

"Curtis Built-Up Terminal Blocks", Electrical Equipment, Oct. 1942, p. 6.

"Curtis Push On-Quick Disconnets CDMQ Series", Bulletin DS-166, Nov. 1965.

Synedvco Modular Terminal Blocks-Brochure-Jan. 1, 1986.

*Primary Examiner*—Gary F. Paumen

*Attorney, Agent, or Firm*—Harness, Dickey & Pierce

[57] ABSTRACT

A modular terminal block assembly having removable terminal block modules which may be individually removed without total disassembly. The base portion of each module has a transverse slot open to the bottom, through which retaining rods pass. Each module also has raised portions around the slots on one side and recessed portions around the slots on the other side of the base portion of the module. The rim portions and recessed portions coact to retain modules placed together in side by side relation. To remove a module, the retaining rods passing through the slot are loosened sufficiently to disengage the rim from the recessed portion of the module, and the individual module is then lifted out of the assembly, the downwardly open slots allowing removal from the retaining rods.

6 Claims, 4 Drawing Sheets

ELECTRICAL POWER DISTRIBUTION TERMINAL BLOCK ASSEMBLY

BACKGROUND AND SUMMARY OF THE INVENTION

This invention relates to an electrical terminal apparatus, and particularly to a modular terminal block assembly enabling a number of individual terminal block modules to be stacked together for power distribution.

For industrial equipment, and particularly resistance welding machines, a large number of high power conductors are connected to power sources within power distribution panels. Frequently, there is a need to provided electrical connections for a number of machines from a single distribution panel. When dealing with high voltage sources, such as 440 VAC, which is often used for resistance welding equipment, the terminals must be well insulated from each other and physically separated to prevent inadvertent contact between adjacent electrical terminals. Along with this requirement for electrical isolation is the need to make the terminal assembly compact for efficient packaging and placement in the crowded environment of the distribution panel.

Instances of mechanical and/or electrical failure of the terminal assemblies necessitate their replacement along with the electrical insulators which separate individual terminals. Accordingly, there is a need for a terminal assembly which facilitates maintenance and repair.

Various designs for high-power terminal assemblies are presently known. The devices which have been in use for many years consist of a plate to which electrical terminals and insulating barrier plates are mounted. Although these devices operate satisfactorily, they suffer the disadvantages in that they are relatively bulky, and provide a fixed number of terminal slots which may not be consistent with the requirements of a particular application.

In an improved design manufactured and sold by the assignee of this application, a modular design terminal assembly (hereinafter called the prior art modular assembly) is provided having a multiplicity of terminal blocks which can be stacked to provide as many individual terminals as necessary. This prior art design provides the advantage of compactness and can be readily adapted for the desired number of electrical connections. Each terminal block provides a mounting point for the electrical terminals, and forms an insulating plate which acts as an insulating barrier between adjacent terminals. The individual terminal blocks of the prior art modular assembly are held together in a stacked configuration by threaded rods which compress the blocks together.

Replacement of a failed terminal or terminal block of the prior art design requires that the entire assembly must be removed from the distribution panel so that the threaded rods can be removed from the assembly to enable an individual terminal and terminal block to be removed. Such replacement requires a significant amount of time and labor, and constitutes wasted downtime for the associated equipment. Accordingly, it is desirable to provide an improved modular type terminal assembly which facilitates replacement of individual terminals and terminal blocks within the assembly.

The upper surface of the insulating plates of the prior art modular terminal assembly described above is covered by dead front safety covers which partially enclose the conductors and terminals. The dead front safety cover also provides a surface where identification labels for the circuits can be provided as an aid in diagnostics and servicing. With present modular terminal block assemblies, a number of individual safety covers is provided, each of which engages several of the insulator plates. When a complete terminal block assembly is disassembled, the separate plates must be removed. When the plates are removed they can be easily mixed up and incorrectly replaced on the device, or lost or damaged. Accordingly, there is a need to provide a safety cover assembly for a modular terminal block which can be mounted and dismounted as a unit.

The improved modular terminal assembly achieves the above mentioned desirable features. The present device is similar to the prior art modular device described above with a number of important design refinements. The holes through the terminal blocks are slotted to allow the block to be placed on the threaded rods between adjacent terminal blocks, thereby avoiding the necessity of axially loading each block on the rod. Accordingly, this design enables replacement of individual terminal blocks without complete disassembly of the entire unit. Moreover, the present device features an improved safety cover assembly having multiple pieces which can be snapped together, thus enabling it to be removed and replaced as a unit.

Additional benefits and advantages of the present invention will become apparent to those skilled in the art to which this invention relates from the subsequent description of the preferred embodiments and the appended claims, taken in conjunction with the accompanying drawings.

DETAILED DESCRIPTION OF THE INVENTION

Figure 1:
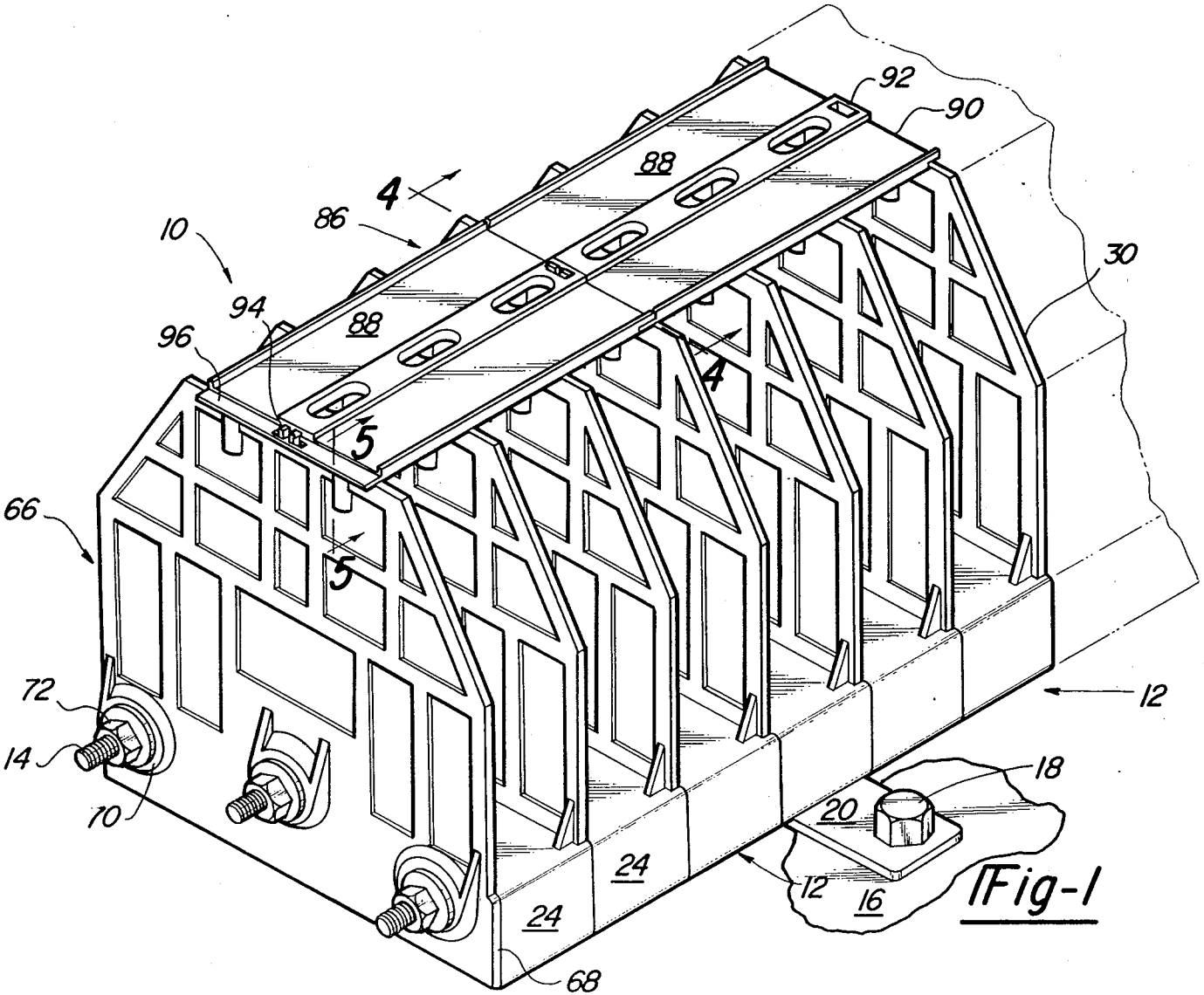
FIG. 1 is a perspective view of the modular terminal block assembly according to the present invention.

In the figures, reference 10 indicates the modular electrical terminal block assembly according to the present invention. Assembly 10 is made up of a plurality of terminal block modules 12 in stacked side by side relation and maintained in an assembled condition by rods 14. The modules are in turn bolted to a surface 16 via bolts 18 passing through mounting plate 20.

Each module 12 includes a terminal block body 22 made of an electrical insulating material such as bakelite. Each module body has a base portion 24, a side cover member 26, a terminal mounting portion 28, and a barrier portion 30. A terminal connector assembly 32 is attached to terminal mounting portion 28. The terminal connector assembly 32 comprises bus bar 34 and connectors 36 for attaching external wires 38 and is bolted via bolts 40 and 42 to the terminal mounting portion 28.

Bolts 40 and 42 are recessed in cavities 44 and 46 in terminal mounting portion 28 which is shaped to accept and hold the heads of the bolts in position. Side cover member 26 has curved projections 48 which fit against the bolts to hold them in place laterally. A screw (not shown) is inserted through hole 50 into recess 52 to secure side cover 26 to terminal mounting portion 28.

Figure 2:
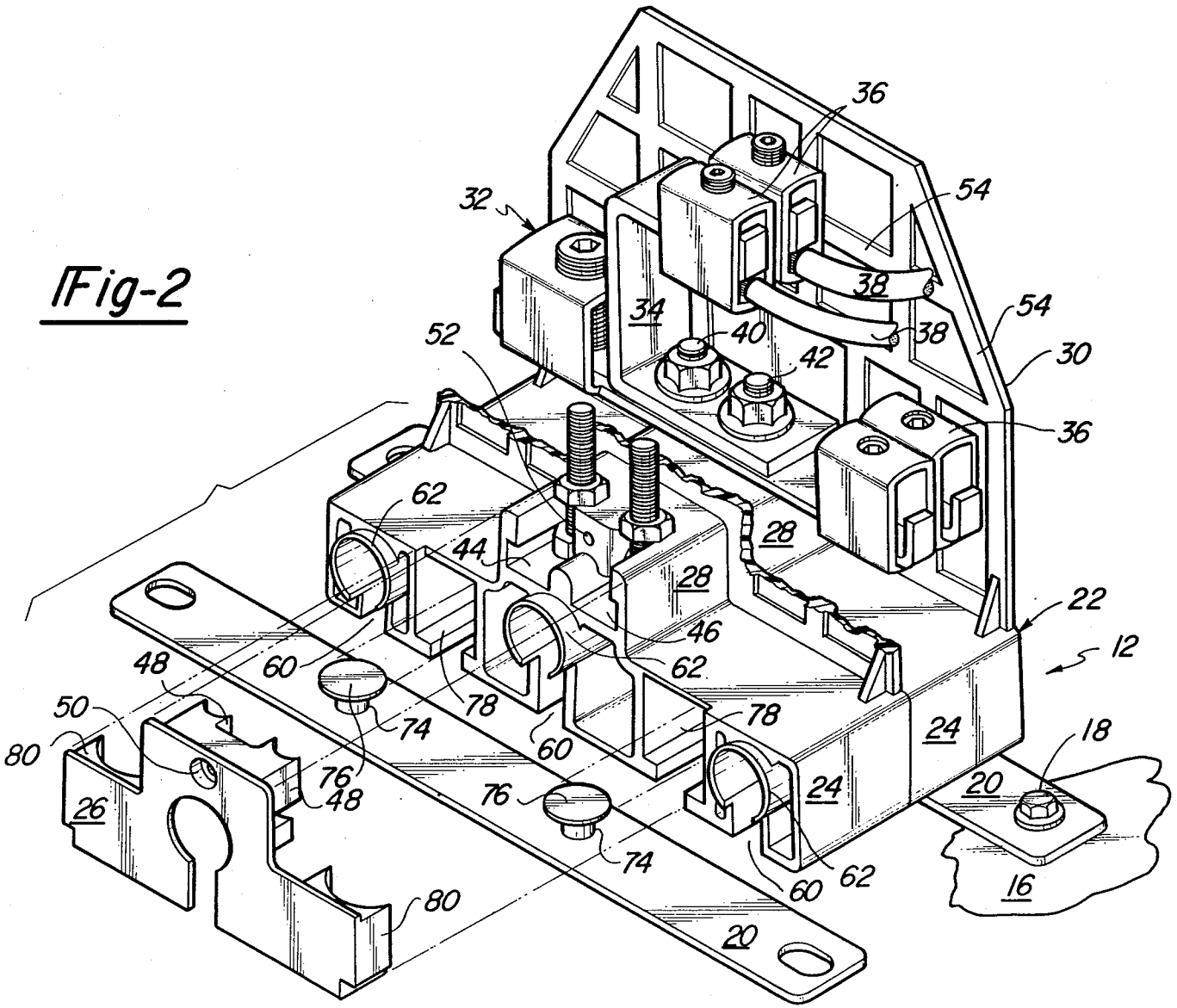
FIG. 2 is a partially broken away perspective view of the terminal block assembly according to the present invention.
Figure 3:
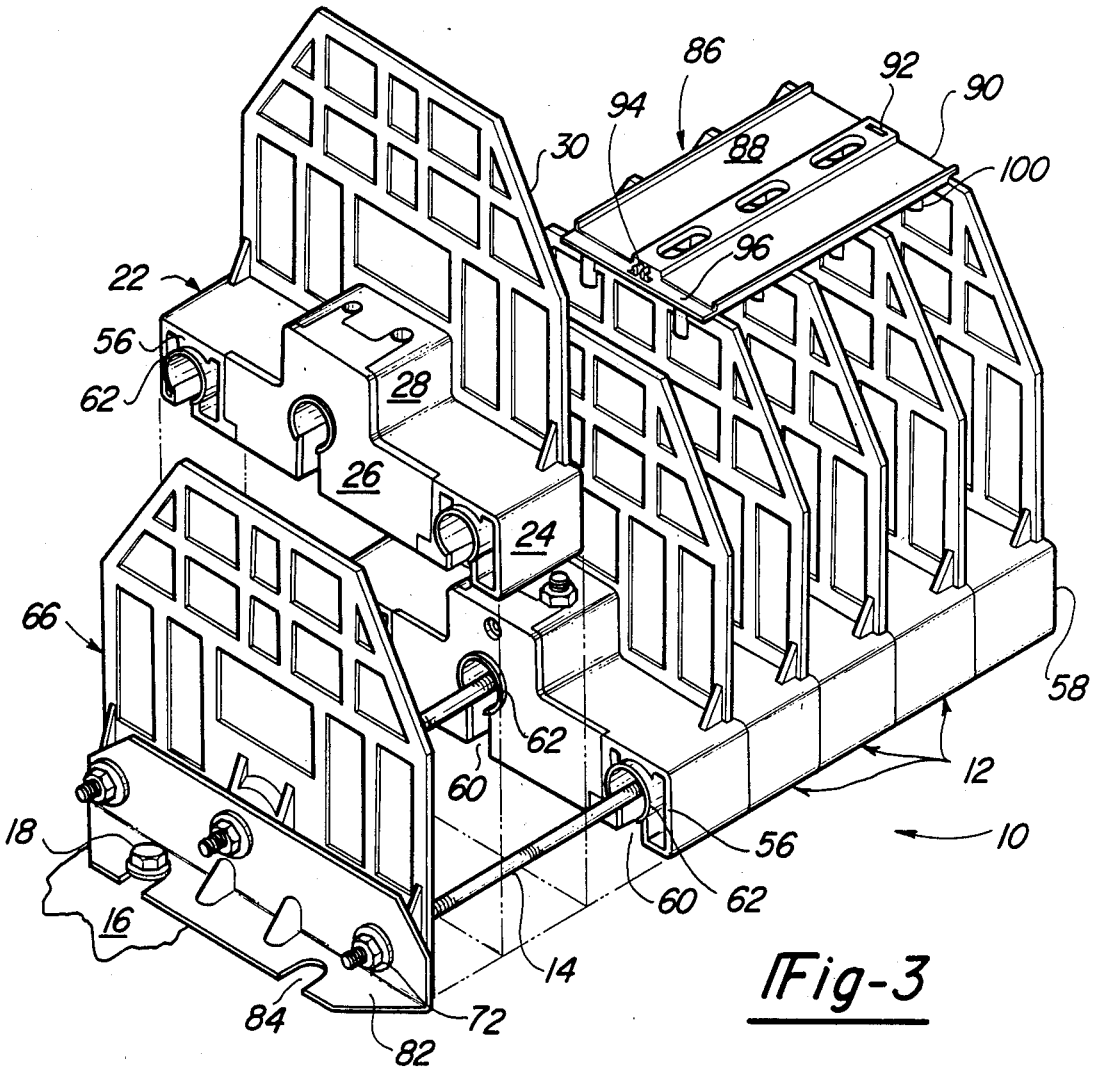
FIG. 3 is a perspective view of the modular terminal block assembly according to the present invention showing insertion and removal of a module according to one embodiment of the present invention.

Terminal connector assembly 32 is of conventional electrical design and may be comprised of various configurations of connectors, of which connectors 36, as shown, are merely illustrative. Barrier portion 30 comprises a thin vertical wall having reinforcing ribs 54 which is an extension upward of one side of base portion 24. Barrier portion 30 is high enough and wide enough to provide full separation between adjacent terminal connectors 36 of the adjacent modules in their assembled condition as shown in FIGS. 1 through 3. These electrical barriers provide insulation to preclude arc-over between adjacent terminal connectors.

Figure 6:
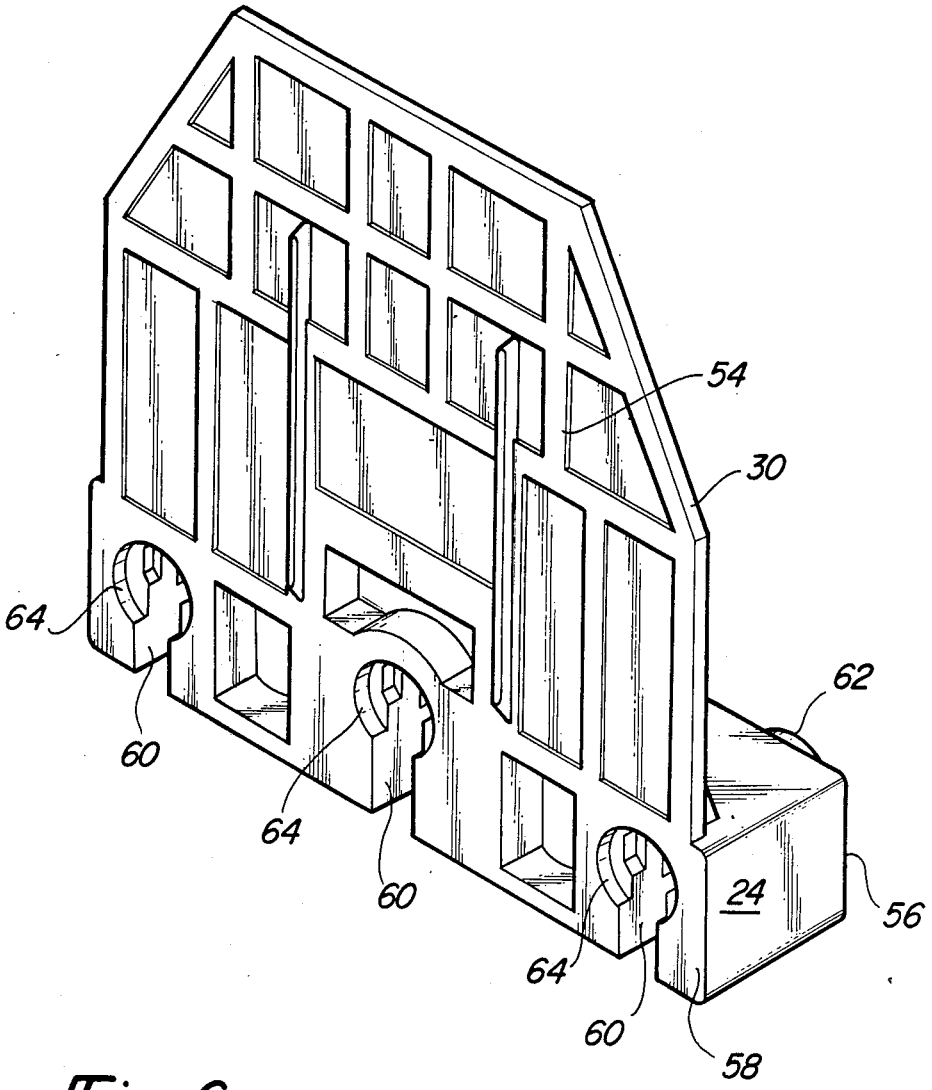
FIG. 6 is a back side perspective view of the module according to the present invention.

As shown in FIGS. 2, 3 and 6, base portion 24 is essentially an elongated rectangular block having a pair of parallel front and back sides 56 and 58, respectively. Several parallel slots 60 extend between sides 56 and 58 through body base portion 24 and are open on the bottom surface of the module. Front side 56 includes outwardly projecting rim portions 62 which project outward around the circular portion of open slot 60. At the other end of slot 60, side 58 has a circular recesses 64 around the circular portions of slots 60, as shown in FIG. 6. These recesses correspond in complementary shape to the raised rim portion 62 so that when two modules 12 are placed together in side by side relation, rim portions 62 fit within the recessed portions 64 of the adjacent module to coact to retain the modules together. In addition, when so aligned, corresponding slots 60 in adjacent modules are aligned so as to form a channel through all of the modules.

An end section 66 is positioned against front side 56 of the last module in the assembly to provide a barrier and terminating plate. End section 66 is similar to barrier portion 30 and back side 58 of the base portion of a typical module. However, in place of the thick base portion 24 of a module, end section 66 has a thin lower portion 68 with three reinforced portions 70 having apertures therethrough for receiving rods 14 and nuts 72.

An assembly 10 is produced by stacking multiple modules 12 together, placing an end section 66 on the last module assembled, inserting three rods 14, each having a nut 72 or head on one end, through the slots 60 from the back side 58 of the first module 12, and through the channels formed by slots 60 in each module and out end section 66. At the front end of the assembly, a nut 72 is placed on the threaded end of each rod 14 which engages the reinforced portion 70 of lower portion 68 of end section 66. The nuts are then threaded onto the rods and tightened to maintain modules 12 in side by side relation. The threaded ends of each rod may then be staked to prevent nut disengagement. The rims 62 and recessed portions 64 maintain proper alignment of the adjacent modules.

The completed assembly may be preferably mounted to a mounting surface 16 by either the method shown in FIG. 2, termed an internal mount, or by utilizing a pair of brackets as shown in FIG. 3 which are positioned at either end of the entire assembly, termed an external mount.

The internal mount is shown in FIG. 2. Plate 20 has a pair of retaining pins 74 projecting from the upper surface thereof which have flat heads 76. Pins 74 fit within recesses 78 in base portion 24 and are retained in position by projections 80 on side plate member 26. Heads 76 coact with the bottom walls of the recesses 78 to fix base portion 24 to plate 20.

The extenal mount is shown in FIG. 3. Brackets 82 are L-shaped metal or plastic members with three holes in one leg for receiving rods 14 and slots 84 or holes in the other leg for receiving mounting bolts 18. One bracket 82 is placed at each end of the assembly and secures the assembly to surface 16 via bolts 18 in slots 84.

In accordance with the invention, an individual terminal block module 12 may be removed and replaced from assembly 10 without disturbing the remaining modules in the assembly. Thus an assembled series of terminal block modules mounted as described above may have an individual module removed for maintenance without removing the entire assembly.

To remove a module, bolts 18 at one or both ends of the assembly are loosened or removed so that the plate 20 or the bracket 82 may be moved sideways. Nuts 72 on rods 14 at one end of the assembly are also loosened. Nuts 72 are not removed. They are prevented from removal by the staking of the threads at the ends of rods 14. When mounting bolts 18 and nuts 72 are loosened by an amount equal to the projection distance of rims 62 from the face 56 of the base portion 24 of an individual module 12, the module may be removed from the assembly as shown in FIG. 3.

With nuts 72 loosened sufficiently so that rims 62 on a module can clear back side 58 of the adjacent module, the module 12 may be lifted out of the assembly due to the clearance between the rods 14 and the body 22 provided by the open slots 60 in the base portion 24. Rods 14 need not be moved or removed.

Thus one or more individual modules can be removed from a completely installed assembly without disconnecting adjacent circuits, removing the adjacent modules or having to remove rods 14 and nuts 72. This allows simplified field maintenance and replacement of broken terminals, barriers, or other replacements required during periodic corrective maintenance.

Dead front safety cover 86, shown in FIGS. 1 and 3 attached to the top of barriers 30 comprises a number of generally flat plate cover members 88 made of an insulating material such as bakelite and positioned end to end. End 90 has an aperture 92 therethrough which engages tabs 94 in the opposite end 96 of an abutting cover member 88 in a snap fit fashion to retain cover members 88 together end to end.

Figure 4:
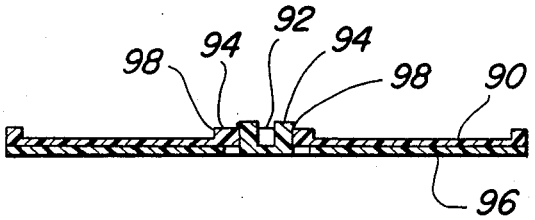
FIG. 4 is a sectional view through the dead front safety cover.

As shown in FIG. 4, a pair of tabs 94 extend upward from end 96, through aperture 92 in end portion 90. Tabs 94 are biased apart and have shoulders 98 which engage the edges of aperture 92 to retain ends 90 and 96 connected together.

Figure 5:
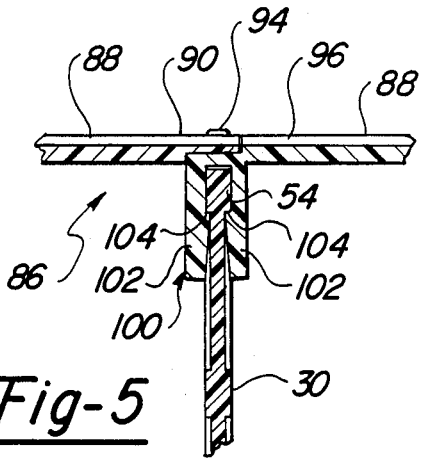
FIG. 5 is a sectional view through the dead front safety cover attached to the barrier portion of the module assembly.

Cover 86 is positioned on barrier portions 30 by a plurality of retaining clips 100 which project downward from the lower side of cover member 88. Retaining clips 100 are shown in engagement with barrier portion 30 in FIG. 5. Retaining clip 100 comprises a pair of downwardly extending deflectable finger members 102. Fingers 102 have internally projecting shoulders 104 which, when retaining clip 100 is pushed over and onto barrier portion 30, engage corresponding shoulders on the outside rib 54 of the barrier portion 30 to retain cover 86 in place. These retaining clips also rigidly maintain separation of the barrier portions 30 from one another.

The configuration of shoulders 104 retains cover 86 firmly in place while also permitting cover 86 to be easily removed as an entire unit. Individual cover members 88 are retained in mated relationship by tabs 94 in aperture 92 during cover removal. Thus any nameplate information that is positioned on the cover is retained in position. This prevents mixing of terminal label information when the cover is replaced onto the barriers.

While the above description constitutes the preferred embodiment of the present invention, it will be appreciated that the invention is susceptible to modification, variation and change without departing from the proper scope and fair meaning of the accompanying claims.

What is claimed is:

1. A modular electrical terminal block assembly for mounting to a support surface and having a plurality of terminal block modules mounted in side by side relation which can be removed individually for servicing, said assembly comprising:

a plurality of terminal block module bodies each made of an electrically insulating material having a base portion, a terminal mounting portion, and a barrier portion;

a terminal connector fixedly mounted on said terminal mounting portion;

coacting retaining means on said base portion interengaging with corresponding coacting retaining means on an adjacent said module body for removably securing said modules together when said modules are placed in side by side relation;

mounting means for mounting said modules to said support surface whereby said modules are secured together and mounted removably to said surface;

said coacting retaining means comprising said base portion being an elongated rectangular block having a first side and a second side opposite and parallel to said first side, a plurality of transverse downwardly open slots in said body extending through said first side and through said second side, said first side having an outwardly raised rim portion around a portion of said slots, and said second side having a recessed rim portion around a portion of said slots shaped complementary to and positioned corresponding to said raised rim portions whereby said slots in adjacent said modules are aligned to form channels therethrough and said raised rim portions of one said module engage in said recessed rim portions of the adjacent said module and coact to retain adjacent said modules together in side by side relation; and a dead front safety cover comprising a plurality of generally flat plate members made of an insulating material positioned over the terminal mounting portions of said modules, said members being of generally rectangular shape and removably connected together end to end, said members each having a plurality of retainers engagable with said barrier portions whereby said cover may be disengaged from said module assembly without separating said members from each other.

2. The assembly according to claim 1 wherein each of said members further comprises:

an aperture in one end of said member;

a retaining tab projecting from the other end of said member whereby adjacent members are connected together by snap fit of said tab through the aperture in another member positioned so as to overlap the tab.

3. The assembly according to claim 2 wherein said tab comprises a pair of parallel, spaced apart outwardly projecting deflectable tab members, said members having outwardly directed shoulders being engagable with the edges of said aperture and biased apart so as to retain said members together.

4. A dead front safety cover for an electrical terminal block assembly having a plurality of terminals therein and insulating barriers separating said terminals, said cover comprising:

a plurality of generally flat plate members made of an insulating material positioned over and onto said barriers, said members being of generally rectangular shape and removably connected together end to end, said members each having a top side and a bottom side;

a plurality of retaining clips projecting downwardly from said lower side of each said member, said clips being removably engagable with said barriers to retain said members on said barriers;

said members each having an aperture adjacent one end of said member through said member; and retaining means projecting from the other end of each said member for engaging said aperture of an adjacent member to join one member to another so as to form said cover, whereby said cover is removable from said barriers without separating said members from one another.

5. The cover according to claim 4 wherein said retaining means comprises:

a pair of spaced apart deflectable tab members projecting upward from said upper surface, said members being biased apart and each having an outwardly directed shoulder, whereby when said tab members on one said member are pushed through said aperture in the end of another said member, said shoulders engage the edges of said aperture to retain said members together.

6. A modular electrical terminal block assembly for mounting to a support surface and having a plurality of terminal block modules mounted in side by side relation which can be removed individually for servicing, said assembly comprising:

a plurality of terminal block module bodies each made of an electrically insulating material having a base portion, a terminal mounting portion, and a barrier protion;

a terminal connector fixedly mounted on each said terminal mounting portion;

coacting retaining means on said base portion interengaging with corresponding coacting retaining means on an adjacent module body for removably securing said modules together when said modules are placed in side by side relation;

mounting means for mounting said modules to said support surface whereby said modules are secured together and mounted removably to said surface; and a dead front safety cover comprising a plurality of plate members made of an insulating material positioned over the terminal mounting portions of said modules, said members being removably connected together end to end, said members each having a plurality of retainers engagable with said barrier portions whereby said cover may be disengaged from said module assembly without separating said members from each other.

* * * * *

UNITED STATES PATENT AND TRADEMARK OFFICE

CERTIFICATE OF CORRECTION

PATENT NO. : 4,854,897

DATED : August 8, 1989

INVENTOR(S) : Ronald M. Grobbel

It is certified that error appears in the above-identified patent and that said Letters Patent is hereby corrected as shown below:

On The Title Page, under "other Publications" (second reference) "Disconnets" should be --Disconnect--.

On The Title Page, under "other publications" (third reference) "Synedvco" should be --Syndevco--.

Column 6, Line 27 after "one" insert --said-- before "member".

Column 6, Line 48 "protion" should be --portion--.

Signed and Sealed this

Twenty-second Day of January, 1991

*Attest:*

HARRY F. MANBECK, JR.

*Attesting Officer*

*Commissioner of Patents and Trademarks*